US006331152B1

(12) United States Patent
Holle

(10) Patent No.: US 6,331,152 B1
(45) Date of Patent: Dec. 18, 2001

(54) THREE DIMENSION BODY MOVEMENT DEVICE

(76) Inventor: Axel Holle, Bertastrasse 12a, D-47445 Moers (DE)

( * ) Notice: Subject to any disclaimer, the term of this patent is extended or adjusted under 35 U.S.C. 154(b) by 0 days.

(21) Appl. No.: 09/269,706

(22) PCT Filed: Oct. 4, 1997

(86) PCT No.: PCT/EP97/05460

§ 371 Date: Jun. 1, 1999

§ 102(e) Date: Jun. 1, 1999

(87) PCT Pub. No.: WO98/15382

PCT Pub. Date: Apr. 16, 1998

(30) Foreign Application Priority Data

Oct. 5, 1996 (DE) ..... 296 17 332 U
Jan. 15, 1997 (DE) ..... 297 00 617 U

(51) Int. Cl.[7] ..... A63G 1/00

(52) U.S. Cl. ..... 482/4; 434/55; 472/27; 472/44

(58) Field of Search ..... 482/4, 6; 434/29, 434/30, 58, 59, 55; 472/1, 29–33, 27, 28, 44–47

(56) References Cited

U.S. PATENT DOCUMENTS

| | | | |
|---|---|---|---|
| 3,276,777 | 10/1966 | Pruitt . | |
| 4,113,250 | 9/1978 | Davis . | |
| 4,741,015 | 4/1988 | Charrier . | |
| 4,799,667 | 1/1989 | Suchy . | |
| 4,961,574 | 10/1990 | Lew . | |
| 5,759,107 * | 6/1998 | Nagel | 434/55 |

FOREIGN PATENT DOCUMENTS

| | | |
|---|---|---|
| 37 31 708 A1 | 4/1989 | (DE) . |
| 0 582 255 A1 | 2/1994 | (EP) . |

* cited by examiner

*Primary Examiner*—Glenn E. Richman

(57) ABSTRACT

The described invention concerns a device enabling the spatial movement of bodies, especially persons, consisting of a contraption allowing a spherical movement, of at least on device capable of holding a person, one steering device, and of at least one input device.

38 Claims, 7 Drawing Sheets

THREE DIMENSION BODY MOVEMENT DEVICE

Figure 1:
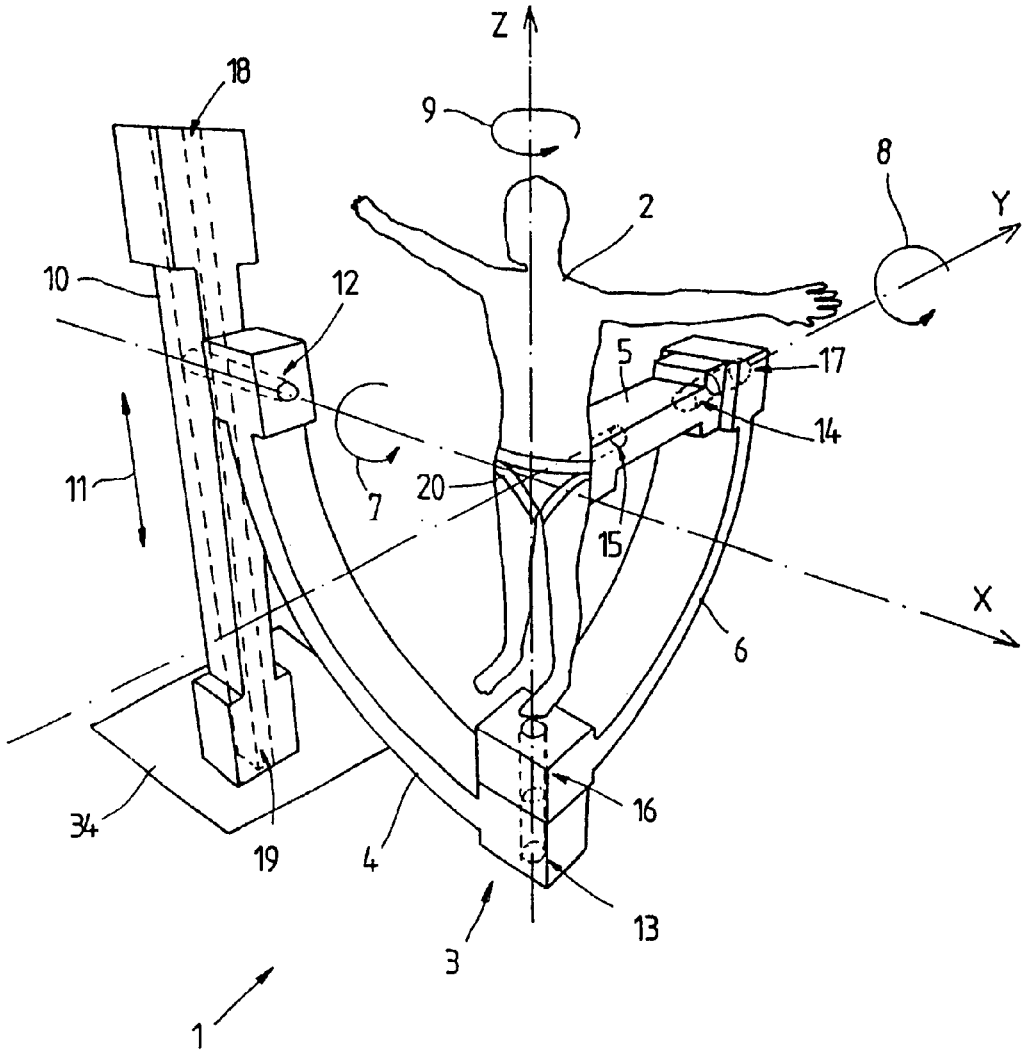

This invention is about a device enabling the spatial movement of bodies, especially of persons.

Such devices are known from the leisure and sports domain, as well as the medical domain, e.g. socalled "Rh önbikes" or human gyroscopes.

From the U.S. Pat. No. 4,799,667 a similar device is known. It consists of 3 circular elements, that are set up in one another. Every circular element is hinged along an axis going through the centre of the circular element. The axes of the three circular segments are positioned in an orthogonal way, in such a way that a body, in this case a person, located in the inner circular element can move freely along the 3 rotational axes in a fixed coordinate system. The body of the person is placed in a certain position and strapped, e.g. by the feet and pelvis. In principle, the arms of the person are free. Because of the fact that movements of the device can only be achieved by shift of the centre of gravity of the body, similar to rocking, the person is forced to hold his hands on the fastening or the circular element in order to move and keep moving.

The freedom of movement of the body, respectively the person is very restricted, similar to the movement of rocking, where shifts of the centre of gravity of the body are enabled by stretching and drawing of the legs.

The dimensions of such devices are relatively big due to the fact that movement can only be achieved or caused by the shift of the centre of gravity. Because of this, the construction of these devices is in most cases symmetrical. This, and the need for stability cause the above mentioned large dimensions of these devices. E.g. the circular elements need a diameter of at least 2 meters, which results in a needed space of about 4 $m^2$ and a spatial volume of about 8 $m^3$. The need for space for the establishment and storage of such a device is enormous. Furthermore, the construction efforts and the involved costs, especially because of the use of full circular segments, but also in the case where rectangular or square segments are used, are relatively high.

Apart from that, all devices known until could not are not respectively allow only restricted steering, especially not by the user, i.e. the person in the device. Furthermore, apart from the sense of motion, i.e. this is the equilibrium organ, no other senses are actively stimulated, e.g. by hearing, seeing, feeling, smelling, respectively tasting through the mouth, the ears, the skin respectively the tactile sense or the nose respectively mouth.

The current invention targets the establishment of a device enabling the spatial movement of bodies, especially of persons, allowing the body, especially the person, a freedom of movement as large as possible, allowing or imposing additionally a movement from within or without, allowing an active influencing of the motion by the body, especially the person. The device is of moderate dimensions and can be built cost effectively by simple means.

To reach this target a device enabling the spatial movement of bodies, especially persons is proposed that consists of a contraption enabling a spherical movement, of at least one device capable of holding a body, one steering device and at least one Input device.

By the use of the contraption allowing a spherical movement and the device capable of holding a person as specified in the invention, this invention has created a device, that enables the persons using it a large amount of freedom of movement. The movement in the device can not only be initiated by the shift of gravity of the body in the device, but can also be initiated by the contraption enabling a spherical movement (as specified in the invention) itself.

Evidently, the motion initiated by the contraption allowing a spherical movement can be overlaid by a motion initiated by a shift of gravity of a person using the device. Combined with the device capable of holding a person as specified in the invention the person using the device can move arms, legs and head freely.

Through the use of a steering device as specified in the invention and an input device, the motion of the bodies can be imposed, steered and influenced from the inside as well as from the outside.

The device as specified in the invention has moderate dimensions, allowing easy storage and transport, minimising space. On top of that it can be built cost effectively by using standard means and components.

In an extended advantageous arrangement of the invention, the device also incorporates at least one device enabling a translation. With this extended version as specified in the invention the possibility is created to allow a body, especially a person besides the spherical movement along the 3 rotational axes, an additional translation movement that creates a feeling of acceleration. In principle, by the use of appropriate devices enabling translations, it is possible to create free spatial movement along the 6 degrees of freedom of a body in space, 3 translations, i.e. a shift in the Y-, Y-, Z- direction and 3 rotations, i.e. e.g. a rotation along the X-, Y- and z-axis.

According to another extended version of the invention the contraption enabling a spherical movement incorporates a system of basically segments oriented in an orthogonal way. In principle, various other angles are possible. Segments as specified in the invention are axes, shafts, cranks and similar components, that especially are formed as angles, circles or quadrant segments. Ellipses or hyperbolic segments can also be used. According to a very advantageous proposal of the invention quadrant segments or or angle segments are used. Through the use of segments the contraption enabling a spherical movement is collapsible. This way, the device as specified in the invention can be stored and transported without disassembly. The device can also be brought to living rooms, i.e. it fits through doors without any problem. Furthermore the device as specified in the invention can be used in private place, such as houses. On top of that the resources have been reduced considerably, to about a fourth, compared to to the use of square or rectangular frames.

According to another advantageous extended version of the invention the contraption enabling a spherical movement and the devices enabling a translation, incorporate at least one propulsion. The segments of the contraption enabling a spherical movement and the devices enabling a translation each incorporate at least one propulsion. The propulsion is an electric and/or pneumatic or similar propulsion. This way, the different movements necessary to cause rotation, i.e. shifts and turns can be initiated in a very simple way. Evidently, appropriate gears and similar components can be placed between the appropriate propulsions and segments. Propulsions as specified in the invention are also combinations of propulsion and gears. It is also possible to switch off one propulsion and to create a free run of the according segment as known from existing devices. Because of that, further degrees of freedom, respectively further movement possibilities are made possible, e.g. a jolting along one axis or a similar movement.

According to an advantageous arrangement of the invention the contraption enabling a spherical movement is located at the device enabling a translation. This allows the device to be built in a more compact and stable way and results in an easier construction.

According to another advantageous arrangement of the invention, the device capable of holding a person is locatable at the contraption enabling a spherical movement, by preference to a segment. In a further advantageous arrangement of the invention the device capable of holding a person incorporates a device enabling a person to sit or lie down. This allows a large freedom of movement, that enables all movements by the device as well as by the person, where the person can move his arms, legs and head freely by an advantageous arrangement of the device capable of holding a person. On top of that, the device capable of holding a person allows a comfortable, adjustable and individually adaptable position According to a further proposal of the invention, the device capable of holding a person consists of at least one belt, fastening or similar item, that can be allocated in a fastening or holding fashion e.g. around the trunk of the body, i.e. e.g in the vicinity of the pelvis.

This guarantees the largest possible degree of freedom of the body, especially the person, so that ideally the limbs, especially the arms, legs and head can be moved virtually freely. The person can also be held by cushioned belts or fastenings in the vicinity of the shoulders. The belts of similar components act as a sort of retaining/holding device for the shoulders and retain the person safely and comfortably.

According to another advantageous arrangement of the invention, the device capable of holding a person contains a hull at least partially enclosing the body, by preference a cushioned bucket seat or similar component. This allows the fastening of the body without any damage. Especially persons are on the one side protected and on the other side optimally held by the cushioning of the bucket seat or similar component. Ideally, the cushioning is conceived is such a way that it adapts to each body individually. Because of this, elastic materials are used by preference, e.g. a material that compresses by itself when elevated pressure is applied, i.e. a material or foam or airbag or similar device that provides a higher protection by its automatic compression.

According to a further advantageous arrangement of the invention the device capable of holding a person incorporates sensory elements and/or elements that cause an action. Sensors or similar components, that measure deformations of the body, temperature and/or humidity changes, pulse, blood pressure, shifts of the centre of gravity or similar measurements, can be used for this purpose. These can be integrated e.g. in the cushioning of the bucket seat, the device capable of holding a person, or can be an integral part of it. By elements that cause an action it is e.g. possible to apply a light pressure to the body by an air pad that can be filled or emptied. In such a way, additional information can be supplied to the body.

According to another advantageous arrangement of the invention, the input device is located outside of the device enabling the spatial movement of bodies, especially persons as specified in the invention. For this purpose the input device, e.g. a keyboard or similar component of a computer can be used to steer the device, to control or steer the different operating modes and conditions of the device as specified in the invention. Furthermore, the steering device can be disconnected from the device, e.g. with a appropriate distance form the device in another room or building. It is also possible that the device as specified in the invention is controlled or influenced from the outside by modem or aerial connection or a similar component.

According to another advantageous arrangement of the invention, the input device is located inside of the movement device as specified in the invention. Almost any input element can be used, that e.g. enables an optical, acoustic or mechanical input, e.g. sensory elements, so-called data gloves, date helmet, speech input and similar items. In this way, a steering of the device as specified in the Invention can be realised by speech of tactile inputs, e.g. by data glove, body steering by sensors that are incorporated in appropriate suits, steering by the tongue or similar procedures. The device as specified in the invention can also be steered by eye movement, that is e.g. controlled and interpreted through cameras that are incorporated in the data helmet. This allows the use of the device as specified in the invention by very ill or physically handicapped people, e.g. as a form of therapy. The user of the device is given the possibility to move the device actively the easiest way possible.

According to a further advantageous arrangement of the invention the movement device as specified in the invention also incorporates at least one information output device. This information output device can provide optical, acoustic, as well tactile information, that has a direct impact on the sensory organs of the person, e.g. by applying pressure to the body by inflatable and deflatable air cushions.

The information output device can be a data helmet, but also usual displays or projection spheres, speakers, headphones, ventilators creating air currents, water particle sprayers, devices spreading different aromas or similar components. The use of an information output device, especially a data helmet, that separates the person using the device optically and acoustically from reality in such a way that the person only perceives the optical and acoustical information provided by the data helmet, allows a feedback between the movement and the steering of the movement, that is initiated by the user, respectively his/her reaction on the movement and the Information provided by the information output device, e.g. video sequences, sounds and similar features.

By this, the influencing of at least one more sense is giving during the movement of persons. In this way, the device as specified in the invention can be used in the medical sector, e.g. for the therapy of different phobias and/or illnesses or similar conditions, e.g. agoraphobia, claustrophobia or similar conditions. Furthermore, the device can be used for rehabilitation. Further domains of use are the entertainment sector, especially for video-games or the training of motion sequences for the most different sports disciplines, as elaborated further on.

As information output device a monitor, a display or projector/screen combination can be used, that in combination with a device enabling a person to lie or sit down alternatively or additionally provides a further possibility of active movement influence or can be used as a computer aided working place. By preference, an arched screen or projection surface is used, to give the person a optimised field of perception.

In a further advantageous arrangement of the invention, the steering device is can be linked to the contraption enabling a spherical movement and the input device. Advantageously, the steering device can also be linked to the device enabling a translation and the information output device. This way, all propulsions and gears of the movement devices as well as all in- and output devices can be steered by means of the steering device.

According to a further advantageous arrangement of the invention, the steering device consists of at least one computer, e.g. a personal computer with steering software and/or micro-controller, devices enabling steering or similar devices. Computers according to the presented invention are also logic devices, automates and similar devices that enable the realisation of steering tasks.

By means of the steering device as specified in the invention several operating modes of the device as specified in the invention can be steered and controlled. By the use of input devices incorporated in the device, the person can influence the steering device from the inside as well as from the outside.

Further very advantageous domains of application are to be found in the leisure and sports sector. As an example motion sequences for almost any sports discipline, e.g. parachuting, high jump, synchronous swimming, but also martial arts and similar sports can be studied and trained by using the movement device as specified in the invention. Furthermore, as already explained, the movement device can be used very efficiently for the therapy of ill and handicapped persons, e.g. rehabilitation, therapy of claustrophobia , fear of heights and memory training, where especially in the last example, the audio visual impressions combined with movement elevate the degree of perception and therefore the ability to remember.

According to another advantageous proposal of the invention, the movement device, as specified in the invention, can be used to steer robots, to set up robots or to programme them. E.g. robots can be operated, steered, set up or programmed for several production procedures . Furthermore, the movement device can be used for product development or product construction. In this way, e.g. newly developed products can be put in a virtual space, that can then be observed by the the user of the movement device as specified in the invention without physically prescribed boundaries from several perspectives and viewing points, without any programming language knowledge, by only using his normal way of moving, especially form all sides, e.g. flight over the product, i.e. bird perspective. Furthermore, the advantages of virtual representation of production items and similar items can be used, e.g. cuts through different product parts.

The movement device can also be used in the field of medical education, e.g. operations on virtual humans or animals. Another domain is the use in the entertainment industry, e.g. video games or similar items. The movement device as specified in the invention can also be used in the business domain, e.g. administration of documents or as a working place. Using the invention, a very comfortable computer screen working place is created, that suppresses the usual combination of chair, table and computer screen. The personnel can, e.g. take place in a device allowing him to sit or lie down where the computer screen is replaced by a combination of an arched screen and projection unit.

The personnel can, according to his needs, adapt his body position enabling a more relaxed and comfortable way of working. A further advantageous domain of application is to be found in the use of the movement device as specified in the invention in the military domain. It can e.g. be used for the steering of martial robots, mine clearing and disarming robots, or also deep sea or research robots, as well for the training and education of helicopter and jet pilots, as well as for parachute jumping.

Further advantages and features of the invention can be derived from the below descriptions of the execution examples portrayed in the figures.

Figure 2:
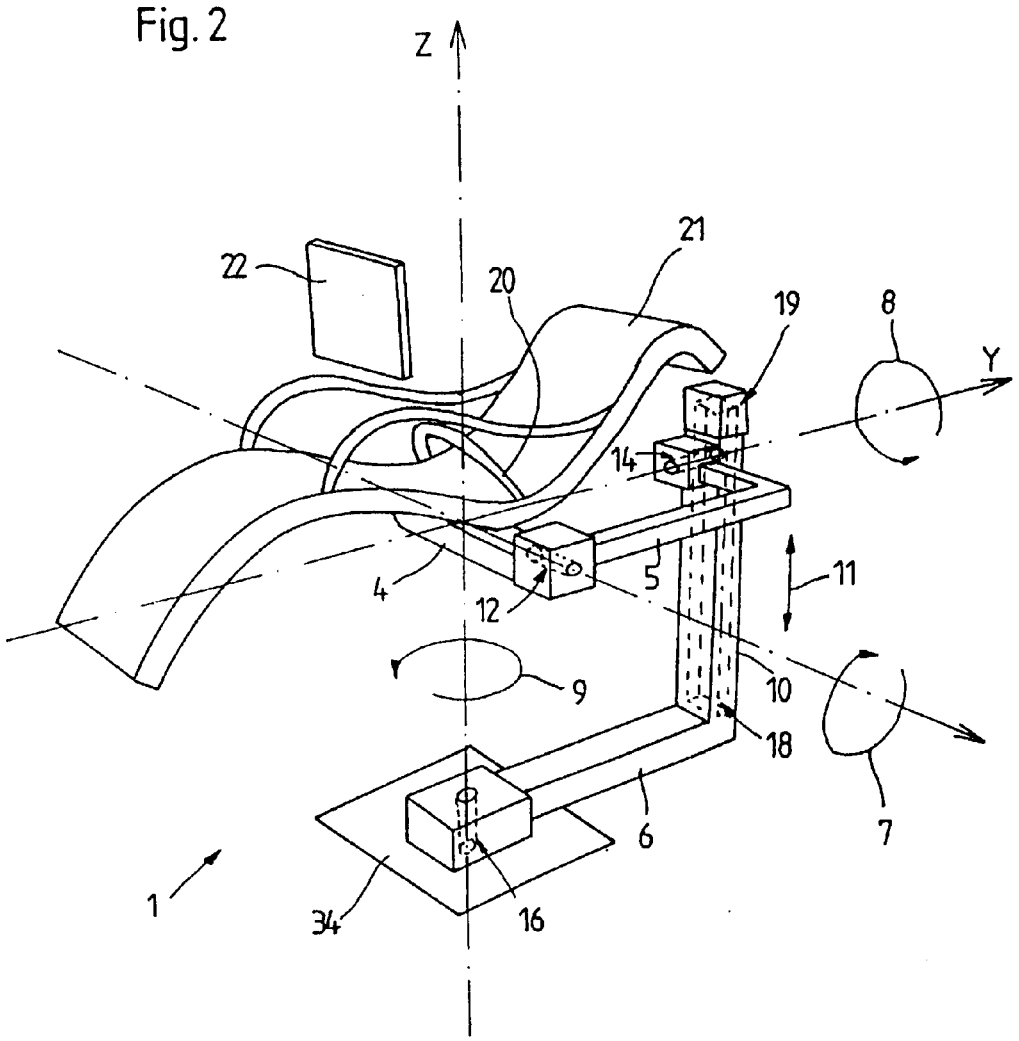
Figure 3A:
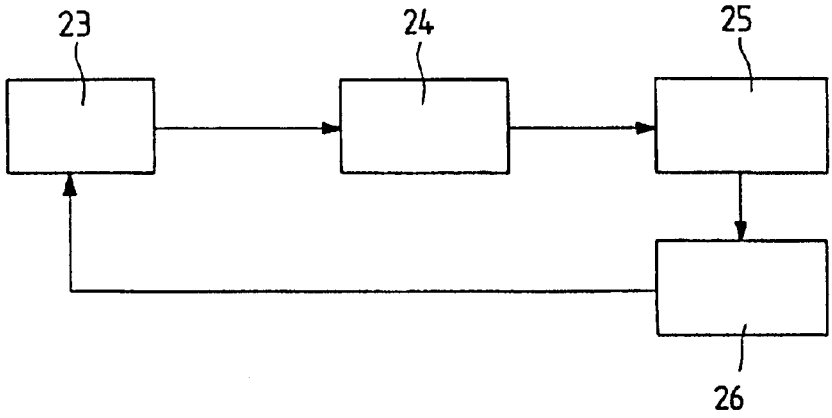
Figure 3B:
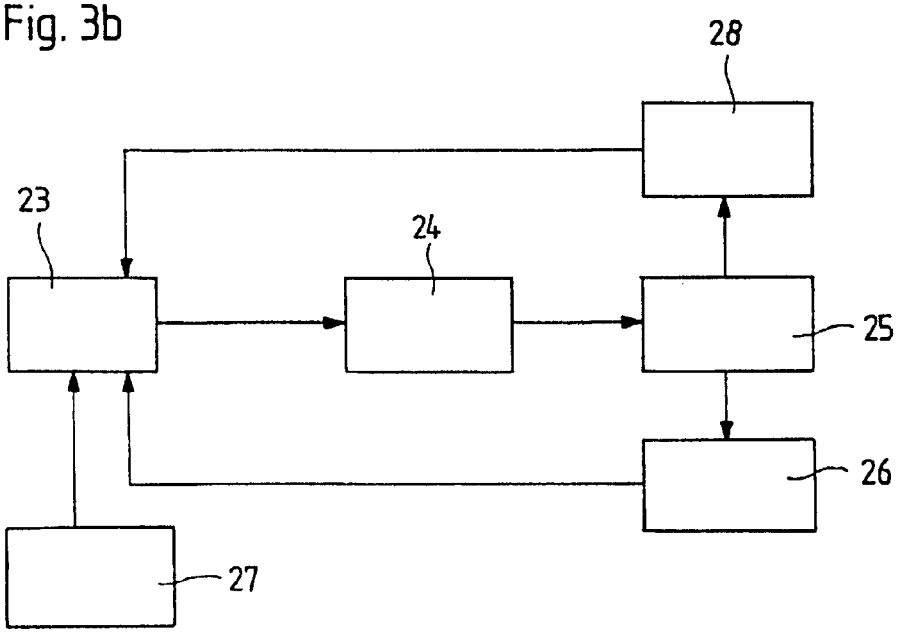

FIG. 1 a schematic-perspective view of a device enabling the movement of bodies as specified in the invention;

FIG. 2 a schematic-perspective view of another device enabling the spatial movement of bodies as specified In the Invention;

FIG. 3*a* and FIG. 3*b* each a block diagram of an operating mode of the device as specified in the Invention and FIG. 4*a* to FIG. 4*d* an application example of the device as specified in the invention FIG. 1 and FIG. 2 each portray a movement device as specified in the invention 1 enabling the movement of a body 2, especially a person. The movement device 1 is situated in a space defined by the axes X, Y and Z, where the co-ordinate axes X, Y, Z are oriented in such a way, that they are parallel to the movement axes of the body 2. The device 3 of the movement device 1 is used to enable a spherical movement and is defined by the segments 4, 5 and 6, that are positioned in an orthogonal way in their freedom of movement, that allow the according rotational movements 7, 8 and 9 along the X-, Y- and Z-axis. The attachment device 1 is connected to the floor by a fastening 34. Evidently, other fastenings or attachments are possible.

In the movement device 1 portrayed in the execution example in FIG. 1, the segments 4 and 6 for a rotation 7 and 9 along the X- and Z-axis are portrayed as quadrant segments, in FIG. 2 as angle segments. Both execution examples portray the segment 5 for the rotation 8 along the Y-axis as an in principle straight axis, respectively shaft.

The movement device 1 is collapsible in a space-saving way, by turning the segments 4, 5 and 6 of the device enabling a spherical movement 3 in such a way that they come to lie in one another. Because of the fact that only quadrant segments are used, the space needed in this condition is very limited and compared to full segments reduced to about half. The movement device 1 is very easily transportable and does not even have to be disassembled. It fits through doors without any problems.

The device 3 of the movement device 1 enabling a spherical movement is linked to a device 10 enabling a translatory movement, in this case a translation 11 oriented in Z-direction. With this, the possibility is created to give body 2, additionally to the spherical movement by a rotation 7, 8 and 9 along the X, Y and Z-axis, a translatory movement in the Z-direction, giving the person a sense of acceleration.

This sense of acceleration can be executed in every direction , because of the fact that the body 2 of the person can be positioned freely through the device 3 enabling a spherical movement. It is also possible to overlay several translatory movements when multiple devices enabling a translation are implemented.

The segments 4, 5 and 6 as well as the device 10 enabling a translation 11, incorporate a not explicitly portrayed propulsion and/or gear combination. These are steered, influenced and controlled by the steering device explained in FIG. 3*a* and 3*b*. They can also be switched off and on, enabling e.g. a centrifugal movement by "enabling" propulsions respectively gears.

As can be seen in FIG. 1 the body 2, in this case the person is held in the pelvis area, at least from the back-side by a device capable of holding a person 20. The device capable of holding a person 20 is connected to the device 3 of the movement device 1 enabling a spherical movement, in this case at the end 15 of the segment 5 enabling a rotation 8 along the Y-axis. The body 2 of the person is on the one side held safely and on the other side enjoys a maximum degree of freedom of movement, especially because arms, legs and free can be moved freely. The head and shoulder area can be held respectively supported by shoulder straps, a steering could then be performed e.g. by eye initiated steering.

As can be seen in FIG. 2 it incorporates a device 21 enabling a person to sit or lie down for a person not depicted in this figure. The device 21 enabling a person to sit or lie down incorporates a holding device 20 applied in the pelvis area to safely hold and fasten the person in the device 21 enabling a person to sit or lie down. The device 21 enabling the person to sit or lie down and the holding device 20 are cushioned and incorporate not explicitly depicted sensory elements and elements that cause an action. The person is on the one side held safely and comfortably and on the other side is given a maximum of freedom of movement, especially because hand, arms, legs and head are almost freely movable. Furthermore an information output device 22, in this fig. as an example a display, is attached to the device enabling a person to sit or lie down 21. An attachment for the display is not depicted for reasons of clarity. The display can however be attached to the device enabling a person to sit or lie down 21 or to the movement device 1. When combined with a information input device, e.g. a keyboard, an ergonomic working place can be presented, e.g. for word processing or office jobs, telephone ordering services or similar services.

FIG. 3 shows in a block diagram a first operating mode of the movement device 1, further on called centrifugal movement. With a computer constituting the steering device 23, e.g. a PC or an automate, each of them with an input device, e.g. a keyboard or mouse, several of the propulsion-gear combinations 12 to 19, that are depicted with the number 25 in the block diagramme, are given information on angles to adopt or respectively signals to process, that are processed by an amplifier 24 or filter circuits or similar components. The propulsions incorporate appropriate sensors 26 respectively are connected to them. The sensors 26 evaluate the current angles an lead them, respectively the corresponding signals to the steering device, i.e. computer 23. In this first operating mode, the so-called "centrifugal movement", the movement of device 1 and with this the body is only influenced from the outside.

FIG. 3*b* shows, also in a block diagram, a second operating mode of the movement device 1. In principle, it corresponds to the first operating mode. It has however been extended by a sensor 28 to capture or register energy values and an internal input device 27, e.g. a unit comprising a sensory element, like a data glove. Through the input device 27 additionally signals can be transmitted to computer 23, that can influence the propulsion-gear combinations 25 through amplifier 24. The propulsion-gear combinations 25 in the presented case are connected to a further sensor 28, that is used to capture or register energy values of propulsion-gear combination 25. The values are transmitted to steering device 23, just like the angle values registered by sensor 26. This enables two feed-backs of the propulsion gear combination 25 to the steering device through the sensors 26, 28 and at the same time an input device that in this case comprises sensory elements, is put in place.

Independently of the used different input devices, in this case the sensory elements of the inner input device 27, two different operating possibilities arise from the second operating mode.

In the case where data, used for the definition of the weight shift by the body, can be captured through the sensory elements, e.g. pressure sensors that are attached to the body 2, e.g. a data glove or similar item, the so-called "weight shift mode" is established.

To do that, a reference ride is made with the body 2, where the sensors 26 and 28 measure 2 characteristic body values. This also allows the determination of inertia moments of several different bodies by use of the movement device 1. A data input by the person using the movement device 1 is not imperative, but in principle possible. During this reference ride, the e.g. energy consumption of the propulsion and gear combination 25, that corresponds to the moving mass of body 2 and its inertia moment is determined by sensor 28.

During this reference ride, sensor 28 determines values e.g. the energy consumption of the propulsion and gear combination 25. These values correspond to the moving mass of the body 2, the inertia moment and other values. By doing this, e.g. simulation parameters can be determined respectively generated.

After that, in the so-called "hovering mode" of the computer of steering device 23, new to be angles are calculated, taking into account the sensor data that has been registered by the sensory elements of unit 27, the angle data registered by sensor 26 of the propulsion-gear combinations 25 and the energy data of the energy figures measured by sensor 28 of the gear-propulsion combination 25. Independently of the In computer 23 programmed and predestined motion sequences, appropriate movements can then be executed. Through the input device 27, inside of movement device 1, an interactive motion is then established. Additionally, through the input device located outside of the device 1, motions can be steered actively independently of this interactive movement.

After the already mentioned reference ride, the motion, apart from the data input through weight shifts, can be influenced through the use of these sensory elements. Through the computer 23, that can be part of an appropriate steering device, by using information output devices. e.g. a data helmet, additionally video sequences and similar items can be established.

In FIGS. 4*a* to 4*d* the use of the movement device 1 for production processes, in this case car manufacturing respectively assembly, is portrayed.

Figure 4A:
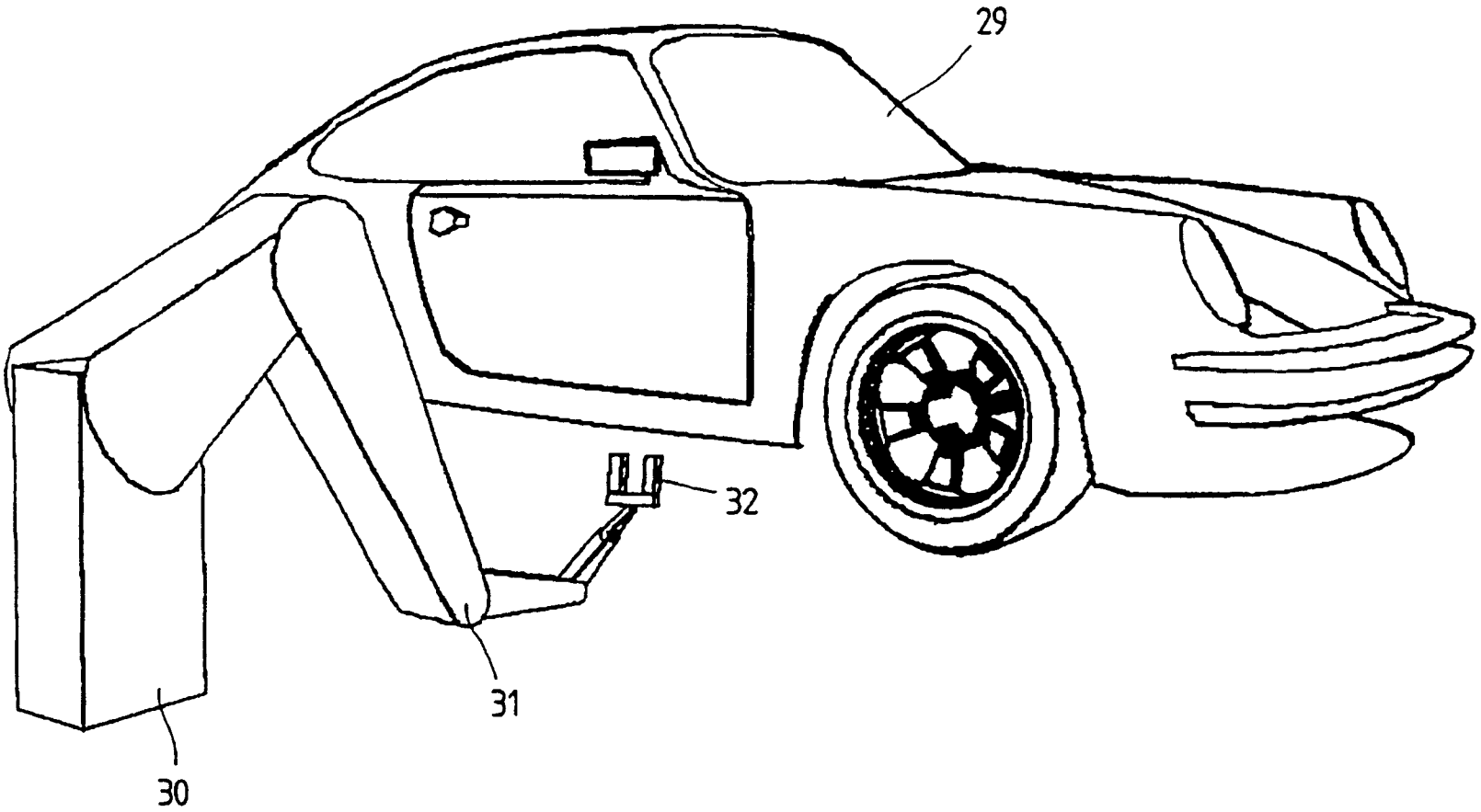

In FIG. 4*a* a part of a real production process is depicted. Here the assembly of car 29 is depicted. The holding devices that are used in automated production sites, e.g. conveyor belt assembly lines, are not explicitly portrayed. Normally such production sites incorporate about several robots 30, of which one is portrayed in FIG. 4*a*. The robots 30 incorporate several hinged robotic arms, that have different tools 32 at their ends, e.g. screwing devices, welding devices, presses or similar items.

The steering and programming, respectively the set-up of such robots is very difficult and complicated and demands a huge amount of experience and knowledge. In most cases, the programmer does not dispose of the manual ability and especially not a sufficient amount of experience to secure quality standards and similar Items that are to be implemented within such an assembly line. On the other hand, the personnel that has knowledge of the production processes is not able to programme, respectively set up robot 30.

The movement device 1 solves this problems. The personnel takes place in movement device 1 and is e.g. equipped with a data helmet incorporating speakers, microphone, data gloves and other sensory elements or elements that cause an action. The in FIG. 4*a* real production site is determined, e.g. digitised and portrayed in a virtual space, i.e. transformed.

Figure 4B:
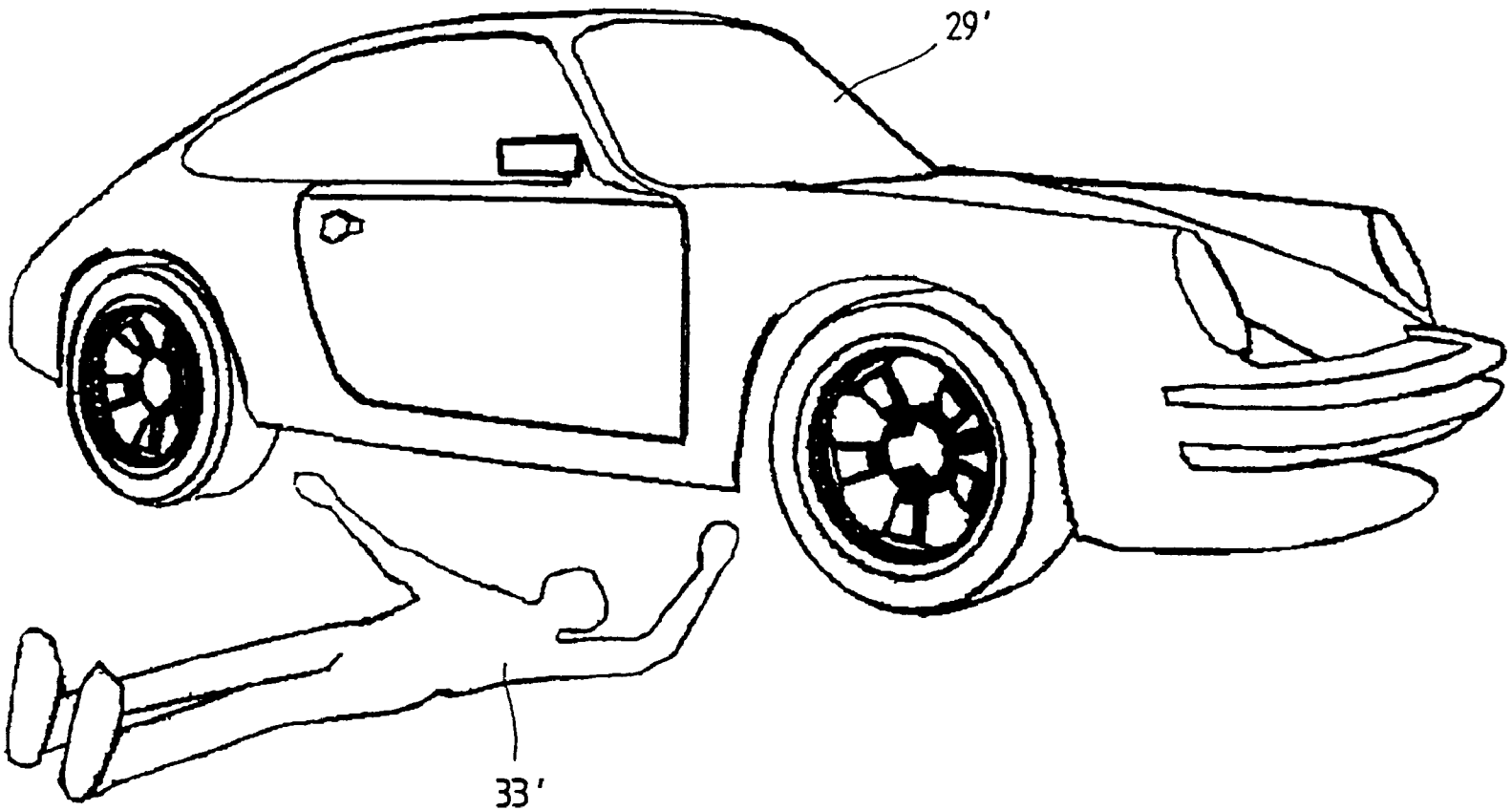

In FIG. 4*b* the transformed image seen, is the production site viewed from an outsider's point of view. FIG. 4*b* shows the virtual production site according to FIG. 4*a* the way the personnel supervising the production site would behold it. FIG. 4*b* shows the transformed version of the car 29' and the production personnel, respectively operator 33, the way an outsider would see him in the virtual space.

In FIG. 4*b* the actual tools, that according to the view in FIG. 4*b* should also be depicted as virtual tools used for the different actions, are not depicted. Using a view according to FIG. 4*b*, the production process and condition can be supervised from the outside, especially the progress of every action can easily be monitored.

Figure 4C:
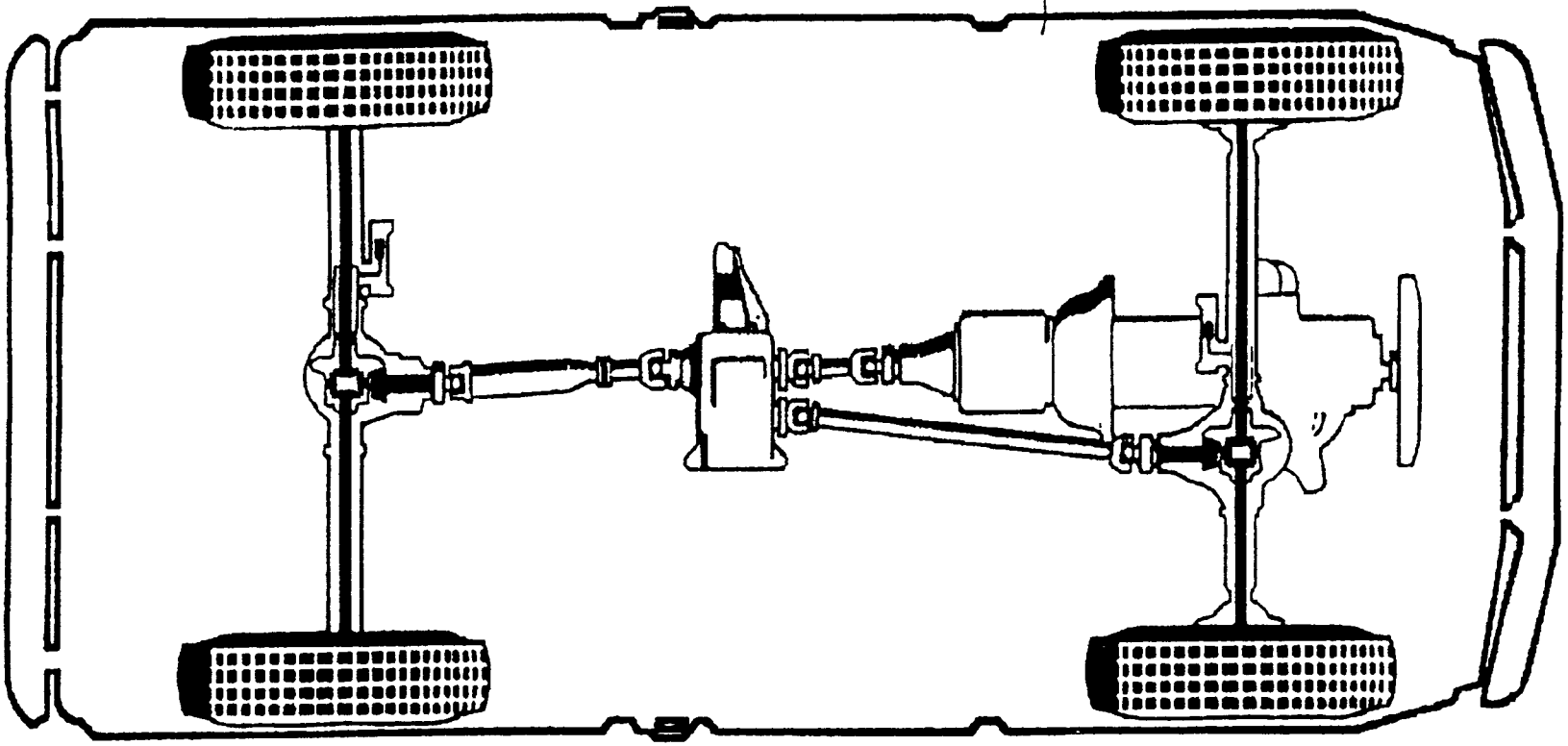

FIG. 4*c* shows the virtual picture that needs to be established for the operator 33, according to the production action depicted in FIG. 4*b* of the car 29 respectively 29', through the data helmet, i.e. the view the operator 33 would see, when he would really be working under the car 29.

Figure 4D:
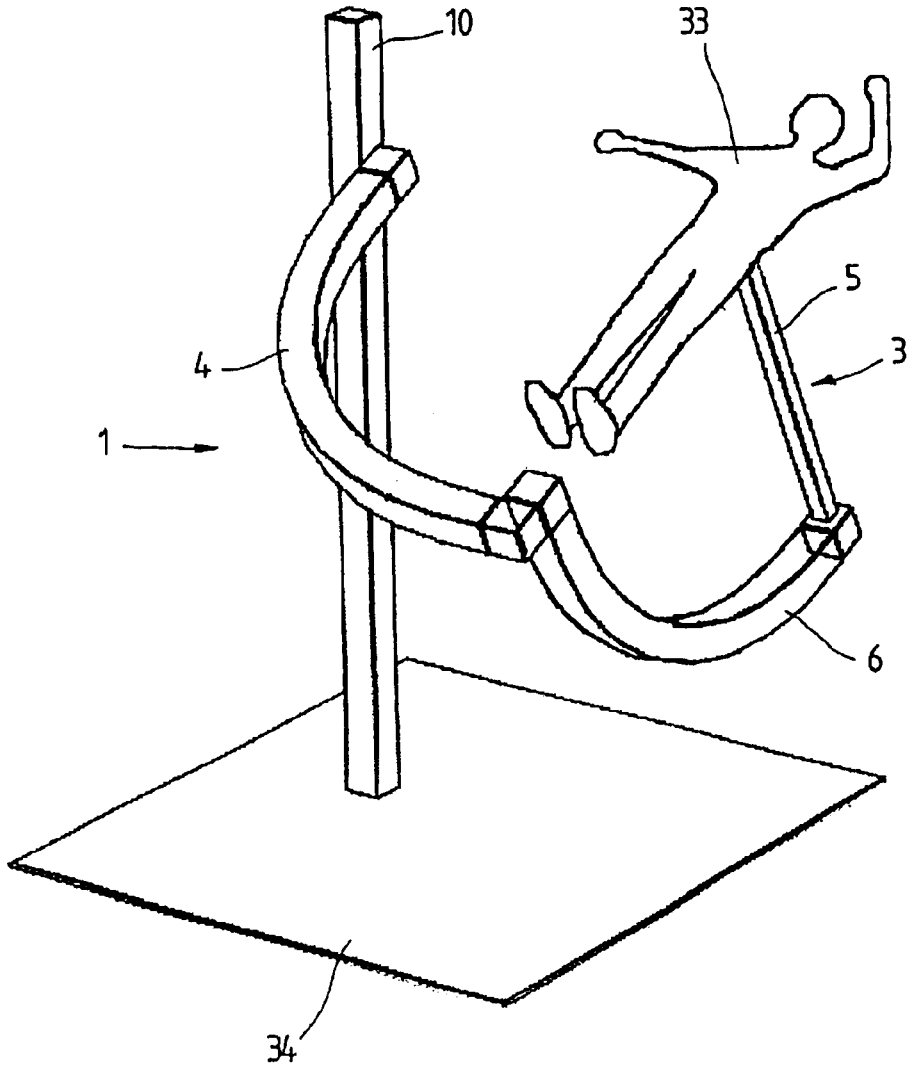

In FIG. 4*d* the real movement device 1 with operator 33 is depicted. The view according to FIG. 4*d* is the way an outsider would see the production site if he were separated from the in FIG. 4*a* portrayed production site and the in FIG. 4*b* and 4*c* different virtual views of the production site.

The operator can perform different jobs on the production item, in this case car 29, much more easily and in a less straining way by means of the movement device 1. The operator 33 steers in a very easy way by means of his natural movement the robot 30 or also several robots. He can work the way he normally would, holding the for him usual position and way of working, as shown in FIGS. 4*b* to 4*d*. The robot 30 however can be set up and used individually for the assembly and production of the production item. E.g. it could be advantageous to transport the car bottom up along the assembly line and to let the several robots necessary for the production act from above, which would be very difficult and straining for the operator 33 under normal production conditions.

In the virtual space, the operator 33 can take or put aside tools necessary for the production in a very simple way, without really having to store or get them. Furthermore, the virtual tools are weightless and the operator doesn't need to apply any force to them to screw or perform similar actions. The movement device 1 supports movements initiated by operator 33 automatically by means of propulsion-gear combinations. On top of that, the operator can easily shift his working position and his position relative to the production item, in this case the car 29. In this way, the operator can e.g. by means of voice input request or take the next production item or another tool, or change his position, respectively view of the production item according to FIG. 4*c*.

What is claimed is:

1. A device for moving people in space, comprising:

a mechanism for producing a spherical movement;

at least one device for holding a person on the mechanism producing spherical movement;

at least one input device for at least one of planning and influencing the spherical movement; and a controller connected to both the mechanism for producing spherical movement and the input device.

2. The device of claim 1, further comprising:

at least one mechanism for producing translation.

3. The device of claim 2, wherein the mechanism for producing spherical movement is arranged on the mechanism for producing translation.

4. The device of claim 2, wherein the controller is connected to the mechanism for producing translation.

5. The device of claim 2, wherein the mechanism for producing translation has at least one drive.

6. The device of claim 5, wherein the drive is an electric drive.

7. The device of claim 5, wherein the drive is a hydropneumatic drive.

8. The device of claim 1, wherein the mechanism for producing spherical movement is made up of a system of segments that are generally orthogonal to one another.

9. The device of claim 8, wherein at least one of the segments is designed to be angular in shape.

10. The device of claim 8, wherein at least one of the segments is designed to be circular in shape.

11. The device of claim 8, wherein the segments are designed to be quarter-circle segments.

12. The device of claim 8, wherein the segments of the mechanism for producing spherical movement has at least one drive.

13. The device of claim 12, wherein the at least one drive is arranged on an end of at least one of the segments.

14. The device of claim 12, wherein the at least one drive is controlled by the input device.

15. The device of claim 1, wherein the device is collapsible.

16. The device of claim 1, wherein the mechanism for producing spherical movement has at least one drive.

17. The device of claim 16, wherein the drive is an electric drive.

18. The device of claim 16, wherein the drive is a hydropneumatic drive.

19. The device of claim 1, wherein the at least one holding device includes a shell case that at least partially encloses the body of the person.

20. The device of claim 1, wherein the holding device includes a sitting or lying device.

21. The device of claim 1, wherein the holding device includes an airbag to stop the person.

22. The device of claim 1, wherein the holding device includes at least one bar to stop the person.

23. The device of claim 1, wherein the holding device includes at least one belt to stop the person.

24. The device of claim 1, wherein the at least one input device is arranged outside of the device.

25. The device of claim 1, wherein the at least one input device is arranged outside of the device.

26. The device of claim 1, wherein the at least one input device permits mechanical entry.

27. The device of claim 1, wherein the at least one input device permits acoustical entry.

28. The device of claim 1, wherein the at least one input device permits optical entry.

29. The device of claim 1, wherein the at least one input device includes at least one sensory analysis element.

30. The device of claim 1, further comprising:

at least one information output device.

31. The device of claim 30, wherein the at least one information output device outputs information optically.

32. The device of claim 30, wherein the at least one information output device outputs information acoustically.

33. The device of claim 30, wherein the at least one information output device outputs information by scanning.

34. The device of claim 30, wherein the information output device is a data home.

35. The device of claim 30, wherein the information output device has at least one update element.

36. The device of claim 30, wherein the controller is also connected to the information output device.

37. The device of claim 1, wherein the holding device includes at least one of sensory analysis and update elements.

38. The device of claim 1, wherein the device can be used for at least one of therapy purposes, control production facilities, control and setting up of robots, study movement routines, and screen work place.

* * * * *